US009502780B2

(12) United States Patent
Chau et al.

(10) Patent No.: US 9,502,780 B2
(45) Date of Patent: Nov. 22, 2016

(54) ANTENNA ARRAY USING SANDWICHED RADIATING ELEMENTS ABOVE A GROUND PLANE AND FED BY A STRIPLINE

(71) Applicant: Northrop Grumman Systems Corporation, Falls Church, VA (US)

(72) Inventors: Loc B. Chau, Fullerton, CA (US); Sudhakar K. Rao, Rancho Palos Verdes, CA (US); Steven J. Mass, La Palma, CA (US); Dana Quincey, Cerritos, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 125 days.

(21) Appl. No.: 14/597,785

(22) Filed: Jan. 15, 2015

(65) Prior Publication Data

US 2016/0211585 A1 Jul. 21, 2016

(51) Int. Cl.

| | |
|---|---|
| ***H01Q 1/38*** | (2006.01) |
| ***H01Q 21/24*** | (2006.01) |
| ***H01Q 9/28*** | (2006.01) |
| ***H01Q 21/06*** | (2006.01) |

(52) U.S. Cl.

CPC ..... *H01Q 21/24* (2013.01); *H01Q 9/285* (2013.01); *H01Q 21/062* (2013.01)

(58) Field of Classification Search

CPC ..... H01Q 1/247; H01Q 21/24; H01Q 9/285; H01Q 21/062

USPC ..... 343/700 MS, 767, 795, 807, 846, 853

See application file for complete search history.

(56) References Cited

U.S. PATENT DOCUMENTS 4,063,246 A * 12/1977 Greiser ..... H01Q 21/065 343/700 MS
4,587,524 A * 5/1986 Hall ..... H01Q 9/38 343/729
4,843,400 A * 6/1989 Tsao ..... H01Q 21/065 343/700 MS (Continued)

FOREIGN PATENT DOCUMENTS

| | | |
|---|---|---|
| EP | 2738868 | 6/2014 |
| WO | 2011064586 | 6/2011 |
| WO | 2011064587 | 6/2011 |

OTHER PUBLICATIONS

Othman, M.A. et al; UWB Bowtie 2 × 2 array antenna for UWB mobile communication system; Information and Communication Technology (ICoICT), 2013 International Conference of , pp. 336-339; Mar. 20-22, 2013.

(Continued)

*Primary Examiner* — Tho G Phan

(74) *Attorney, Agent, or Firm* — Patti & Malvone Law Group, LLC

(57) ABSTRACT

An exemplary antenna array has first self-complementary antenna cells, e.g. bowtie antennas, disposed in a first plane in rows and columns. Additional bowtie antenna cells are disposed in a second plane parallel to the first plane and are aligned in corresponding rows and columns. A first stripline disposed between the first and second planes carries RF signals to/from the first and second bowtie antenna cells. A slot feed couples the RF signals between the first stripline and each of the first and second bowtie antenna cells. A conductive layer in a third plane parallel to the first and second planes serves as a ground plane for signals radiated from/to the first and second bowtie antenna cells.

21 Claims, 7 Drawing Sheets

(56) References Cited

U.S. PATENT DOCUMENTS

| | | | | |
|---|---|---|---|---|
| 5,166,697 | A * | 11/1992 | Viladevall | H01Q 1/287 343/727 |
| 6,191,740 | B1 * | 2/2001 | Kates | H01Q 1/38 343/700 MS |
| 6,329,958 | B1 * | 12/2001 | McLean | H01Q 1/40 343/700 MS |
| 6,429,819 | B1 | 8/2002 | Bishop et al. | |
| 6,842,140 | B2 | 1/2005 | Killen et al. | |
| 7,310,065 | B2 | 12/2007 | Anguera Pros et al. | |
| 8,643,554 | B1 | 2/2014 | Manry, Jr. et al. | |
| 8,717,245 | B1 | 5/2014 | Krivokapic et al. | |
| 8,884,834 | B1 * | 11/2014 | Paschen | H01Q 9/28 343/795 |
| 2007/0126641 | A1 | 6/2007 | Saily | |
| 2013/0222199 | A1 | 8/2013 | Apostolos et al. | |

OTHER PUBLICATIONS

Shi-Wei Qu; Millimeter-wave cavity-backed antenna array with high gain and simple structure; Wireless Symposium (IWS), 2013 IEEE International, pp. 1-3; Apr. 14-18, 2013; 978-1-4673-2141-9/13.

Zhang, F. et al; Wide band antenna array using bowtie-shaped microstrip patch antenna; Microwave and Millimeter Wave Technology (ICMMT), 2010 International Conference on, p. 424-427; May 8-11, 2010; 978-1-4244-5708-3/10.

Jiang, K. et al; Design of a wideband quasi-Yagi microstrip antenna with bowtie active elements; Microwave and Millimeter Wave Technology (ICMMT), 2010 International Conference on, pp. 1122-1124; May 8-11, 2010; 978-1-4244-5708-3/10.

Kaswiati, W.S. et al; Design and realization of planar bow-tie dipole array antenna with dual-polarization at 2.4 GHz frequency for Wi-Fi access point application; Telecommunication Systems, Services, and Applications (TSSA), 2012 7th International Conference on, pp. 218-222; Oct. 30-31, 2012; 978-1-4673-4550-7/12.

Sabaawi, A.M.A. et al; Planar Bowtie Nanoarray for THz Energy Detection; Terahertz Science and Technology, IEEE Transactions on, vol. 3, No. 5; pp. 524-531; Sep. 2013.

Li, M. et al; A Low-Profile Unidirectional Printed Antenna for Millimeter-Wave Applications; Antennas and Propagation, IEEE Transactions on, vol. 62, No. 3; pp. 1232-1237; Mar. 2014.

Qui, S. et al; Wideband and High-Gain Composite Cavity-Backed Crossed Triangular Bowtie Dipoles for Circularly Polarized Radiation; Antennas and Propagation, IEEE Transactions on, vol. 58, No. 10; pp. 3157-3164, Oct. 2010.

Erickson, R. et al; Wideband and Wide Scan Phased Array Microstrip Patch Antennas for Small Platforms; Antennas and Propagation, 2007; EuCAP 2007; The Second European Conference on, pp. 1-6; Nov. 11-16, 2007.

Sarkar; S. et al; A compact proximity-coupled bow-tie microstrip antenna using stubs for ultra-wideband application; Informatics, Electronics & Vision (ICIEV), 2013 International Conference on, pp. 1-5I May 17-18, 2013; 978-1-4799-0400-6/13.

* cited by examiner

ANTENNA ARRAY USING SANDWICHED RADIATING ELEMENTS ABOVE A GROUND PLANE AND FED BY A STRIPLINE

BACKGROUND

This invention relates to an antenna array having pairs of sandwiched radiating elements and a stripline transmission feed of signals to/from the elements. The antenna array is implemented as part of a layered printed circuit board like assembly.

Conventional self-complementary antennas, e.g. bowtie antennas, have been utilized for various purposes such as for the reception of broadcast UHF television signals. Although a single bowtie antenna can be utilized, an array of bowtie antennas is commonly utilized to increase gain, for example an antenna array having 4 active bowtie antenna elements all disposed in the same plane. A balun (balanced to unbalanced) transformer is normally used to couple the bowtie antenna elements to a transmission line to provide a match of the antenna impedance and the impedance of the feed line.

Another antenna design utilizes a patch antenna structure. For example, a patch antenna may utilize a conductive element spaced apart from a ground plane. A patch antenna may utilize a plurality of radiating elements to increase gain and/or achieve a desired radiation pattern.

The design and construction of a practical wideband antenna array having wide scan capabilities has proved to be challenging. Many antennas require the use of a balun as part of the feed mechanism in order to provide an impedance match of the radiating elements to the transmission mechanism. A balun has inherent signal loss and will likely have less than optimal signal transfer characteristics over a wide frequency range. For an antenna array utilizing a substantial number of radiating elements, a balun will likely be required to feed each of the radiating elements or group of elements. In addition to these difficulties related to having one or more baluns, such an antenna array is costly to manufacture. Where a dipole antenna is used, especially without the use of a balun, it is difficult to maintain symmetry of feed point.

A desirable characteristic for a wideband antenna array is the ability to select horizontal or vertical polarization without requiring physical movement of the antenna array. Many conventional antenna arrays have a single fixed polarization orientation requiring the physical rotation/movement of the antenna array to effectuate a change of polarization. This can be implemented but it is at the expense of additional structure required to control the physical rotation/orientation of the antenna array. Such an implementation carries with it additional cost and increased maintenance of the structure. There exists a need for a cost-effective practical wideband antenna array which minimizes at least some of these difficulties.

SUMMARY

It is an object of the present invention to provide an antenna array which provides an improvement in one or more of the following ways. An antenna arrangement, e.g. bowtie antenna, eliminates the normally required use of a balun structure. Bowtie antennas, for example, stacked in upper and lower planes facilitate the use of a stripline and slot feeding mechanism to substantially eliminate asymmetric feed problems. An array of such antennas in rows and columns permits the selection of vertical polarization, horizontal polarization or dual vertical and horizontal polarizations without movement of the array. The antenna array can be manufactured economically using multilayer printed circuit board fabrication techniques.

In accordance with an exemplary embodiment of the present invention, an antenna array has first bowtie antenna cells disposed in a first plane in rows and columns. Additional bowtie antenna cells are disposed in a second plane parallel to the first plane in rows and columns where the additional bowtie antenna cells are aligned perpendicular to and are duplicates of the first bowtie antenna cells. A first stripline disposed between the first and second planes carries RF signals to/from the first and second bowtie antenna cells. A slot feed couples the RF signals between the first stripline and each of the first and second bowtie antenna cells. A conductive layer in a third plane parallel to the first and second planes serves as a ground plane for signals radiated from/to the first and second bowtie antenna cells.

DESCRIPTION OF THE DRAWINGS

Features of exemplary implementations of the invention will become apparent from the description, the claims, and the accompanying drawings in which:

DETAILED DESCRIPTION

Figure 1:
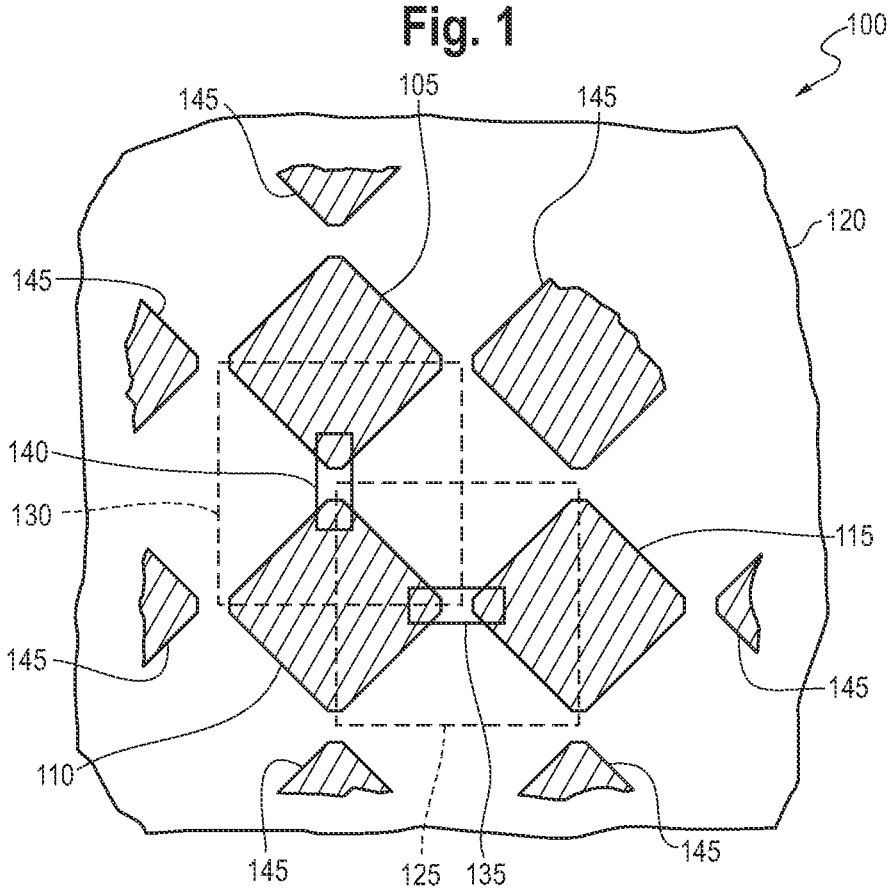
FIG. 1 provides a simplified top view of a portion of an antenna array in accordance with an embodiment of the present invention.

FIG. 1 shows a top view of a portion 100 of an antenna array in accordance with an embodiment of the present invention. In the illustrated portion 100, conductive radiation elements 105, 110 and 115 are shown disposed above a ground plane 120. The portion of radiation elements 110 and 115 enclosed by dashed line rectangular box 125 defines one dipole antenna with horizontal polarization as referenced to a normal portrait orientation of FIG. 1. As used herein, reference to horizontal and vertical polarization is dependent on the physical orientation of the antenna array such that rotation of the antenna array 90 degrees in the plane of the antenna array will change the relative polarizations. The portion of radiation elements 105 and 110 enclosed by dashed line rectangular box 130 defines one antenna with vertical polarization. Hereinafter, the respective antennas will be referred to as antenna 125 and antenna 130.

In the illustrated embodiment the conductive radiation elements are substantially square such that the antennas 125 and 130 form exemplary bowtie antennas. The conductive radiating surfaces of the bowtie antennas expand from the respective feed mechanisms 135 and 140 outwardly to the effective ends of the antennas defined by a midline between opposing vertices transverse to the axis of the antenna. Note that the square continuous radiating surface extends beyond the effective ends of the antennas so that the respective ends of adjoining antennas are connected together.

Each radiation element functions as part of two pairs of end-to-end antennas, one pair of horizontally polarized antennas and one pair of vertically polarized antennas. As illustrative of this relationship, the top half of element 110 forms a bottom portion of bowtie antenna 130 having vertical polarization, the bottom half of element 110 forms a top portion of an adjoining below bowtie antenna having vertical polarization, the left half of element 110 forms a right portion of an adjoining bowtie antenna to the left having horizontal polarization and the right half of element 110 forms a left portion of bowtie antenna 125 having horizontal polarization. The illustrative antenna array has separate and independent feed mechanisms for the horizontally and vertically polarized antennas so that only the horizontally polarized bowtie antennas or vertically polarized bowtie antennas can be coupled via a feed system to an external device, e.g. a receiver and/or transmitter. Alternatively, both horizontally and vertically polarized bowtie antennas can be simultaneously selected and coupled to the external device in which case each radiation element functions as part of four active antennas. Thus, the antenna array may operate with horizontal polarization, vertical polarization or both horizontal and vertical polarization without requiring any movement or change of orientation of the antenna array itself.

When only one of horizontal or vertical polarization is selected for the antenna array, each radiation element effectively functions as part of two different adjoining dipoles. Assuming vertical polarization has been selected for the antenna array, each radiation element in each column on the antenna array will function as part of two adjacent antennas with the respective ends connected together. Similarly each radiation element in each row on the antenna array will function as part of two adjacent horizontally polarized antennas with the respective ends connected together.

Where horizontal polarization has been selected for the antenna array, each radiation element in each row of the antenna array will function as part of two adjacent antennas. For example, the right portion of radiation element 110 and the left portion of radiation element 115 function as one horizontally polarized antenna 125. The left portion of radiation element 110 in combination with the right portion of radiation element 145 to the left of radiation element 110 will function as another horizontally polarized antenna. Likewise, the right portion of radiation element 115 in combination with the left portion of the radiation element 145 to its right will form another horizontally polarized antenna. Each of these horizontally polarized antennas has separate respective feed mechanisms to couple RF signals with the antenna. Similarly each radiation element in each row of the antenna array serves as part of two adjacent antennas.

When simultaneous horizontal and vertical polarization is selected for the antenna array, each radiation element effectively functions as part of four antennas. For example, radiation element 110 functions as part of four different antennas. The top portion of radiation element 110 functions as part of vertically polarized antenna 130 and the bottom portion of radiation element 110 functions as part of another vertically polarized antenna formed with element 145 below radiation element 110. The right portion of radiation element 110 functions as part of a horizontally polarized antenna 125 and the left portion of radiation on the 110 functions is part of another horizontally polarized antenna with element 145 to the left of radiation element 110.

Figure 2:
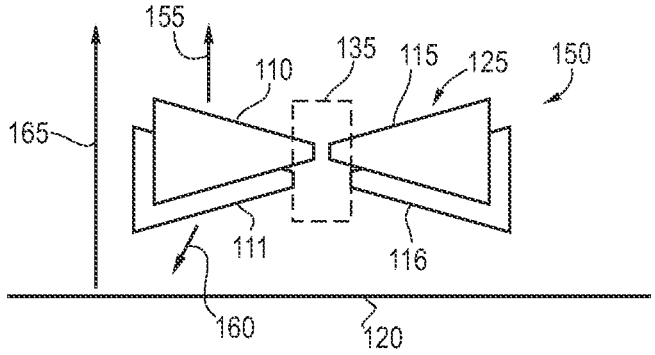
FIG. 2 illustrates bowtie elements representative one cell of the antenna array in accordance with an embodiment of the present invention.

FIG. 2 illustrates a representative horizontally polarized self-complementary antenna cell 150 of the antenna array. Horizontally polarized bowtie antenna 125 includes a left radiating element that is part of element 110 and a right radiating element that is part of element 115. Another horizontally polarized bowtie antenna that is an aligned mirror image of antenna 125 is disposed in a spaced apart plane below and parallel to the plane of antenna 125. That is, radiating element 111 has substantially identical dimensions to the illustrated portion of the radiating element of 110 and radiating element 116 has substantially identical dimensions to the illustrated portion of the radiating element 115. Each of the radiating elements described with reference to FIG. 1 has a mirror image duplicate radiating element disposed in a plane below the plane containing the radiating elements shown in FIG. 1. As will be described in more detail below, the mirror image radiating elements are driven concurrently with the radiating elements as described in FIG. 1. The ground plane 120 is in another spaced apart parallel plane below the radiating elements.

As shown in FIG. 2 the arrow 155 represents direct radiation from the cell 150 in a direction away from the ground plane 120 and generally perpendicular to the plane of the antennas. Arrow 160 represents direct radiation from the cell 150, e.g. especially elements 111 and 116, in a direction towards the ground plane 120. Arrow 165 represents reflected radiation from the ground plane 120 that is substantially parallel to the radiation represented by arrow 155. It is desirable to locate the ground plane 120 a distance about ¼ wavelength at the lowest frequency of intended frequency range of operation from the antennas formed in the lower plane so that the reflected radiation 165 is substantially in phase with the radiation 155 to maximize the composite radiation perpendicular to the plane of the antennas and antenna array.

Figure 3:
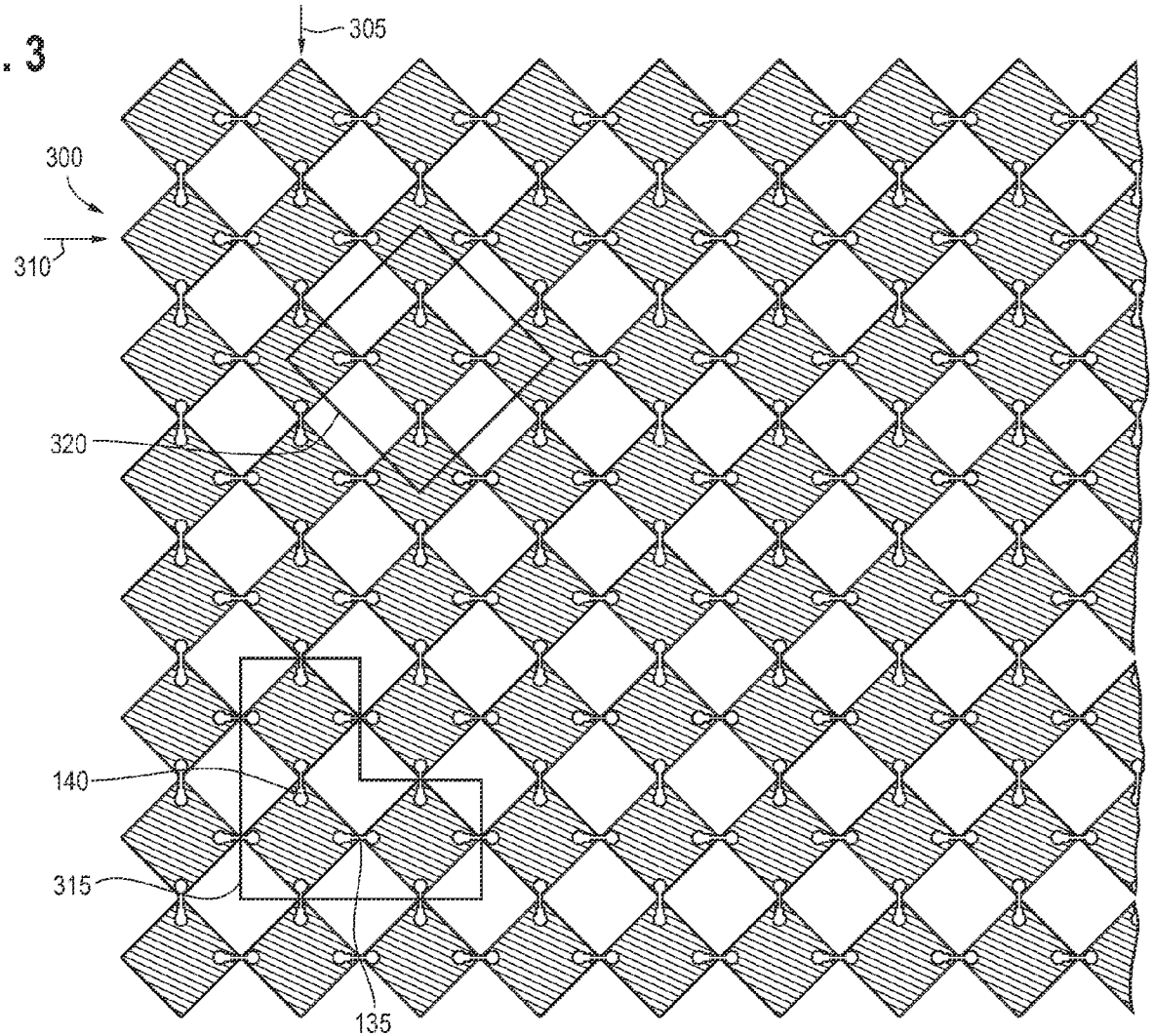
FIG. 3 provides a top view of an exemplary antenna array consisting of a plurality of 2×2 cells in accordance with an embodiment of the present invention.

FIG. 3 shows a representative top view of an antenna array 300 in accordance with an embodiment of the present invention. There are a substantial number of columns 305 and rows 310 of radiating elements. The L-shaped region 315 corresponds with the portion 100 shown in FIG. 1. The illustrative square region 140 defines a representative 2×2 cell containing two horizontally polarized antennas and two vertically polarized antennas. Horizontal polarization feed mechanisms 135 and vertical polarization feed mechanisms 140 are represented by the short horizontal and vertical lines, respectively, connecting adjacent radiating elements. Each vertex of the radiating elements forms an antenna feed point with a vertex of an adjacent radiating element, with the exception of radiating elements disposed along an edge of the antenna array 300. As will be understood, the radiating elements at the edges of the antenna array terminate the respective column or row of the antenna array thereby eliminating the need for a feed mechanism since there is no further radiating element to be fed. As shown at the right edge of the antenna array, the rightmost column of radiating elements may be formed using one half of a normal radiating element to complete a final horizontally oriented bowtie antenna with the corresponding radiating elements in the adjacent left column. As shown at the top edge of the antenna array, the topmost row of radiating elements may be formed using a complete square-shaped radiating element except for the radiating element in the rightmost column. Complete square-shaped radiating elements in the top row, except for the last right radiating element, are desired since each has both horizontal and vertical feed mechanisms requiring the full square-shaped area for completion of a horizontal and vertical bowtie antenna.

Figure 4:
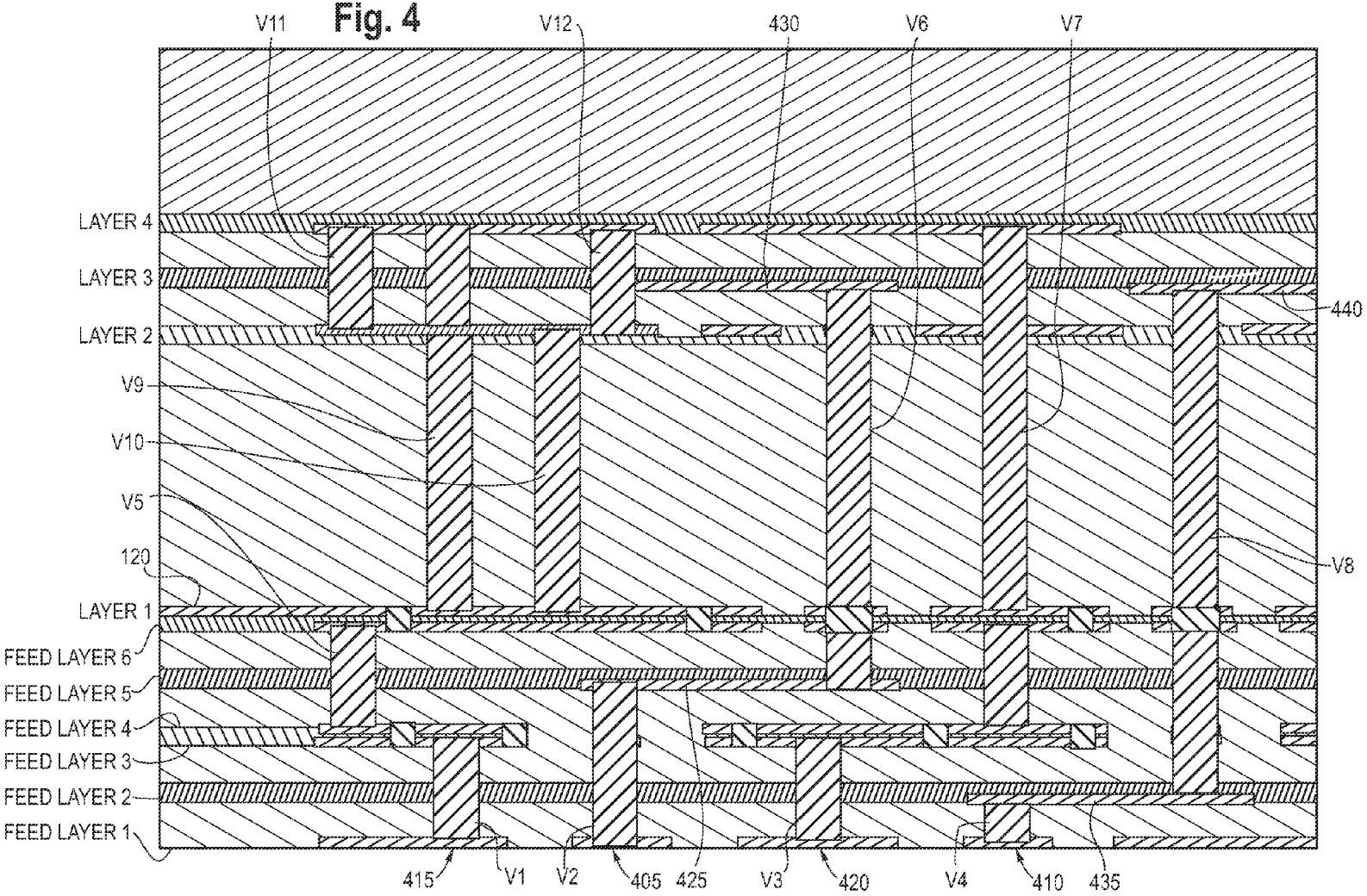
FIG. 4 is a side view of a representational structure of a cell of the antenna array in accordance with an embodiment of the present invention.

FIG. 4 shows a representational side view of an exemplary antenna of the antenna array. The antenna array is formed by a plurality of adjacent layers in a printed circuit board type structure. Preferably, copper is used to form the conductive surfaces and conductive vias are used to provide electrical connection between conductive surfaces on different layers. Various dielectric materials are used as layers between the conductive layers as described below.

"Layers" refer to layers associated with the antennas and RF radiation characteristics and "feed layers" refer to layers associated with coupling of RF signals to/from the antennas. Layer 4 contains the radiating elements such as 105, 110, 115 and 145 as shown in FIG. 1. Layer 2 contains the radiating elements that are the duplicate, mirror images radiating elements of layer 4, e.g. layer 2 contains radiating elements 111 and 116 as shown in FIG. 2 which are duplicate mirror images of radiating elements 110 and 115. Layer 1 forms the RF ground plane 120. Layer 3, disposed in a dielectric material between layers 4 and 2, contains a conductive path that functions as a stripline feed of RF signals and functions as a stripline in cooperation with the conductive paths on layers 4 and layer 2.

The feed layers located below layer 1 serve as part of the RF signal feed system. The conductive feed layer 6 is connected, such as by solder, to layer 1 and thus is part of the RF grounding. Conductive feed layers 4 and 3 are conductively connected to each other and are part of the ground system. The conductive layer 1, adjacent the bottom of the antenna array, is also part of the ground system. Feed layer 5 and feed layer 2 contain conductive paths each disposed in dielectric material between respective ground planes and function as striplines that respectively carry separate horizontal and vertical polarization RF signals from respective connection contacts 405 and 410 at the bottom of the antenna array to/from the striplines 430 and 440, respectively, on layer 3. Connection contacts 415 and 420 provide ground connection contacts for connection with external devices.

A plurality of vertical vias, i.e. conductive paths, serves to interconnect metal areas on different layers. Those skilled in the art will understand that vias may also traverse metal surfaces on an intermediate layer without providing a connection to that surface such as by passing through an opening that does not have conductive material adjacent the opening. Via V1 and V3 provide ground connections from feed layer 1 to feed layer 3.

Via V2 provides a connection between horizontal polarization contact 405 and metallization 425 on the layer 5 that functions as a stripline between ground feed layers 4 and 6. The stripline 425 on layer 5 is connected by via V6 to metallization 430 on layer 3 which also serves as a stripline between antenna metallization layers 2 and 4. The stripline on layer 3 is in turn connected by via V12 to metallization on layers 4 and 2 which serve as mirror image halves of respective bowtie antennas, e.g. serving of part of the horizontal polarization feed points for elements 110 and 111. RF energy from external source, e.g. transmitter, guided by stripline feed on layer 3 is coupled to the gap slot formed by the vertices of back to back bowtie radiating elements. This coupled RF energy is maximally transferred from guided stripline mode to slot radiating mode when the extended portion of the stripline feed on layer 3 is shorted with via V12 to stripline ground, image halves of the bowtie antennas on layer 4 and 2. Via V4 provides a connection between vertical polarization contact 410 and metallization 435 on the feed layer 2 that functions as a stripline between ground feed layers 1 and 3. The stripline 435 is connected by via V8 to metallization 440 on layer 3 which also serves as a stripline feed between layers 2 and 4 which is in turn connected by a via (not shown) to vertically polarized bowtie antenna metallization on layers 4 and 2. The vertical polarization feed system is substantially similar to the horizontal polarization feed system except that radiating elements are fed at corners that are 90 degrees relative to the horizontal feed, e.g. vertical polarization feed mechanism 140 versus horizontal polarization feed mechanism 135 as seen in FIG. 1.

A plurality of interconnections to ground is provided. Via V5 provides a ground connection between feed layer 4 and feed layer 6. It should be remembered that feed layers 3 and 4 are connected together as are feed layer 6 and layer 1. Via V7 also provides a ground connection between feed layer 4 and layer 4. Vias V9 and V10 provide ground connections between layer 1 and layers 4 and 2, respectively. Via V11 provides a connection between layer 2 and layer 4, which is representative of a plurality of such connections between layers 2 and 4. These vias interconnect the mirror image bowtie antenna elements in order to maintain respective points between the two antennas at the same RF signal level (voltage). This is beneficial because bowtie radiating elements on layer 2 and layer 4 also function as RF ground plane for the stripline feed on layer 3, It will be noted that although the antenna elements have a connection to ground at some points, these ground connections do not inhibit RF signal voltages from being present on the radiating elements which correspond to RF radiation from the radiating elements.

In accordance with the described embodiment of the present invention, the materials used for the printed circuit board like construction, especially the dielectric materials, are advantageously selected and dimensioned to facilitate ease of construction as well as provide desired electrical characteristics, e.g. stripline feed impedance, antenna impedance, Referring to FIG. 4, the completed antenna structure is preferably formed by combining three separately formed sandwiches: a bottom sandwich formed by feed layers 1-3; a middle sandwich formed by feed layers 4-6; a top sandwich formed by layer 1 and all layers above it. The conductive layers are preferably formed using ½ ounce copper. Feed layers 3 and 4 are bonded together at multiple locations to conductively secure the bottom and middle sandwiches, and feed layer 6 and layer 1 are bonded together at multiple locations to conductively combine the top sandwich with the middle sandwich. Table 1 below specifies the different dielectric and conductive bonding materials utilized.

TABLE 1

| Layer | Dielectric Material | Dielectric Constant | Dielectric Loss Tangent | Thickness in inches | Temp. |
|---|---|---|---|---|---|
| FL1-FL2 | Rogers 6002 | 2.94 | 0.0012 | 0.005 | |
| FL2-FL3 | Rogers 6002 | 2.94 | 0.0012 | 0.005 | |
| FL4-FL5 | Rogers 6002 | 2.94 | 0.0012 | 0.005 | |

TABLE 1-continued

| Layer | Dielectric Material | Dielectric Constant | Dielectric Loss Tangent | Thickness in inches | Temp. |
|---|---|---|---|---|---|
| FL5-FL6 | Rogers 6002 | 2.94 | 0.0012 | 0.005 | |
| L1-L2 | Rogers 6002 | 2.94 | 0.0012 | 0.050 | |
| L2-L3 | Rogers 6002 | 2.94 | 0.0012 | 0.005 | |
| L3-L4 | Rogers 6002 | 2.94 | 0.0012 | 0.005 | |
| L4+ | Rogers TTM4 | 4.7 | 0.002 | 0.040 | |
| B FL2+; B FL5+; B L3+ | FEP prepreg | 2.1 | 0.00045 | 0.001 | 500 F. |
| B FL3 - FL4; BL2+ | Arlon Prepreg 6700 | 2.35 | 0.002 | 0.0015 | 400 F. |
| B FL6 - L1; B L4+ | Rogers Prepreg 6250 | 2.32 | 0.002 | 0.0015 | 275 F. |

In Table 1: L=layer; FL=feed layer; B=bonding. Reference to FLx-FLy refers to the dielectric material between feed layer x and feed layer y; reference to Lx-Ly refers to the dielectric material between layer x and layer y. A "+" sign refers to the material disposed above the corresponding layer. The last three rows of Table 1 refers to the exemplary non-conductive bonding materials used to bond the indicated feed layer or layer to adjacent layers, e.g. BFL2+ refers to the bonding material that binds the strata below and above feed layer 2 together with feed layer 2. "B FL3-FL4" refers to the bonding material that bonds conductive feed layer 3 with conductive feed layer 4.

Preferably, the exemplary antenna array is assembled using a building block approach of subassemblies, e.g. lower, middle and upper sandwiches. It will be noted that none of the layers utilize a gas or air as a dielectric layer. It will be noted that the bonding agents listed in the last three rows of Table 1 have different respective melting temperatures. The lower and middle sandwiches are each formed with the bonding material having the highest melting temperature, 500° F. The top sandwich itself is formed as further subassemblies that includes bonding layers 2, 3 and 4 together also using the highest temperature bonding agent. Then, the bonding agent with the melting temperature of 400° F. is used to bond the lower and middle sandwiches together and likewise is used to bond the subassembly of layers 2, 3 and 4 to the dialectic material below layer 2. Finally, the bonding agent with the lowest melting temperature of 275° F. is used to bond the top of the middle sandwich (feed layer 6) to the bottom of the top sandwich (layer 1), and also to bond layer 4 with the dialectic material disposed above it. The use of successively lower melting temperature bonding agents to secure subassemblies together is advantageous in that it prevents the bonding material used for previously formed subassemblies from becoming melting, e.g. becoming disassociated (unbonded) or shifting position.

The representative vias as shown in FIG. 4 may be constructed in the least two different ways. First, the vias can be constructed on each of the lower, middle and top sandwiches prior to assembly of the completed antenna array. This technique requires precision since some of the vias traverse some or all of the sandwiches thereby requiring careful via alignment and assembly tolerances to make sure that the conductive continuity intended to be provided by a via is maintained in the final assembled antenna array. Alternatively, the vias may be formed after the final assembly of the antenna array by forming appropriate corresponding holes that are then internally plated with a conductive material.

Figure 5:
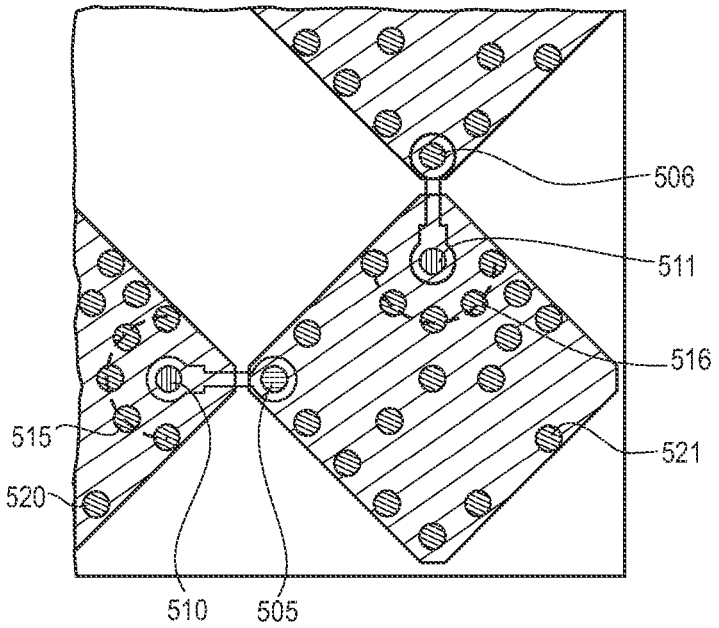
FIG. 5 is a top view of layer of an exemplary cell of the antenna array in relationship to other layers.

FIG. 5 shows a top representative view of layer 4 and some features below showing a portion of the antenna array. The structure associated with the bowtie antenna having horizontal polarization will be discussed first. The top-end of via V12, which connects the stripline on layer 3 with the upper and lower bowtie antenna elements, is shown as element 505. Via V6, located below layer 4 on layer 3, is identified as element 510. An opening around V6 on layer 2 prevents the RF signal coupled by V6 from having a direct connection with the metallization on layer 2 at the V6 location. Similarly, various metallization layers have openings about vias carrying RF signals where the RF signals are intended to only pass through a subject layer. A semicircular set of vias 515, located below layer 4 on layer 2, and encircling V6 provides a piecewise linear approximation of a ground shield of a coaxial cable about V6 that assists in maintaining the desired feed line impedance. The remainder of the vias, e.g. 520, represents vias perpendicular to layer 4 that connect locations on the upper bowtie antenna on layer 4 to corresponding locations on the lower bowtie antenna location on layer 2. These vias serve to maintain the same RF voltage between the upper and lower bowtie antennas at the same relative locations. This serves to inhibit undesired resonances that might otherwise occur.

The structure associated with the illustrated bowtie antenna having vertical polarization is substantially similar to that discussed above with regard to the bowtie antenna having horizontal polarization. Elements 506, 511, 516 and 521 associated with the exemplary bowtie antenna with vertical polarization correspond to the previously discussed elements 505, 510, 515 and 520, respectively, associated with the horizontal polarization bowtie antenna and perform like functions.

Figure 6:
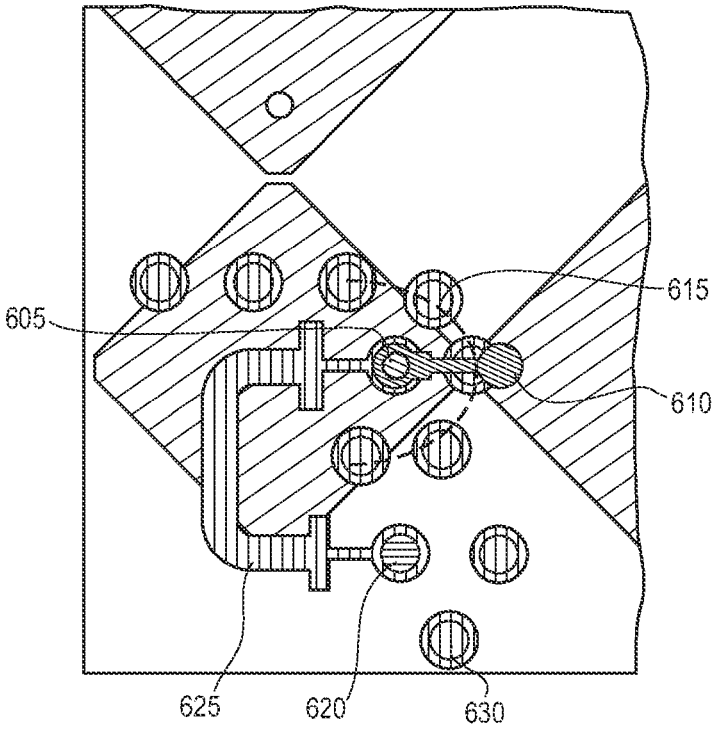
FIG. 6 is a top view showing feed layer 5 in relationship to other layers.

FIG. 6 is a top view representative of feed layer 5 shown in relationship to layers 2 and 3. The bottom of via V6 as seen on feed layer 5 is shown as element 605. For reference, the horizontal polarization feed on layer 3 (which is connected to the upper and lower bowtie elements by a via) is indicated by element 610. The semicircular set of ground vias 615 functions as a piecewise linear RF shield around 605 similar to the shield on a coaxial cable. The top of via V2 that provides an RF feed from feed layer 1 to feed layer 5 is seen as element 620. A strip of metallization 625 on feed layer 5 functions as a stripline and couples the RF signal from the top 620 of via V2 with the bottom 605 of via V6. A plurality of pads 630 provide openings for the passage of a plurality of ground vias represented by via V5 providing a ground path between feed layer 4 and feed layer 6.

Figure 7:
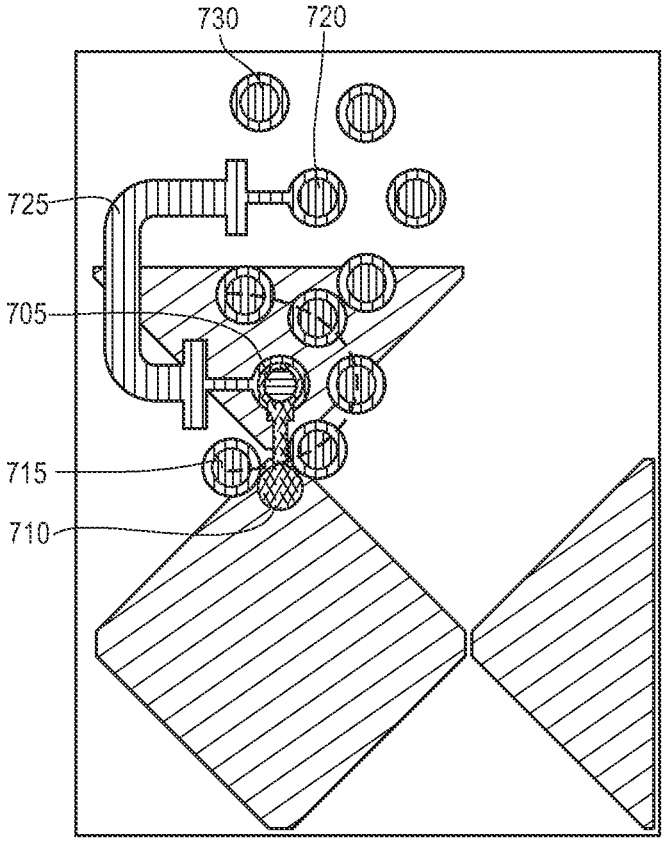
FIG. 7 is a top view showing feed layer 2 in relationship to other layers.

FIG. 7 is a top view representative of feed layer 2 shown in relationship to layers 2 and 3. The bottom of via V8 as seen on feed layer 2 is shown as element 705. For reference, the vertical polarization feed 440 on layer 3 (which is connected to the upper and lower bowtie elements by a via) is indicated by element 710. The semicircular set of ground vias 715 functions as a piecewise linear RF shield around 705. The top of via V4 that provides an RF feed from feed layer 1 to feed layer 2 is seen as element 720. A strip of metallization 725 on feed layer 2 functions as a stripline and couples the RF signal from the top 720 of via V4 with the bottom 705 of via V8. A plurality of pads 730 provide openings for the passage of a plurality of ground vias providing a ground path between feed layer 1 and feed layer 3. With regard to via V8, it will be noted that all of the layers between feed layer 2 and layer 3 provide corresponding openings for V8 so that the RF signal carried by this via is not connected to any of the intermediate layers.

Feed layer 1 is generally a ground layer with openings around the contacts 405 and 410 that support RF signal connections to the horizontal and/or vertical polarized bowtie antennas. The contacts are connected to respective signal carrying vias V2 and V4.

Figure 8:
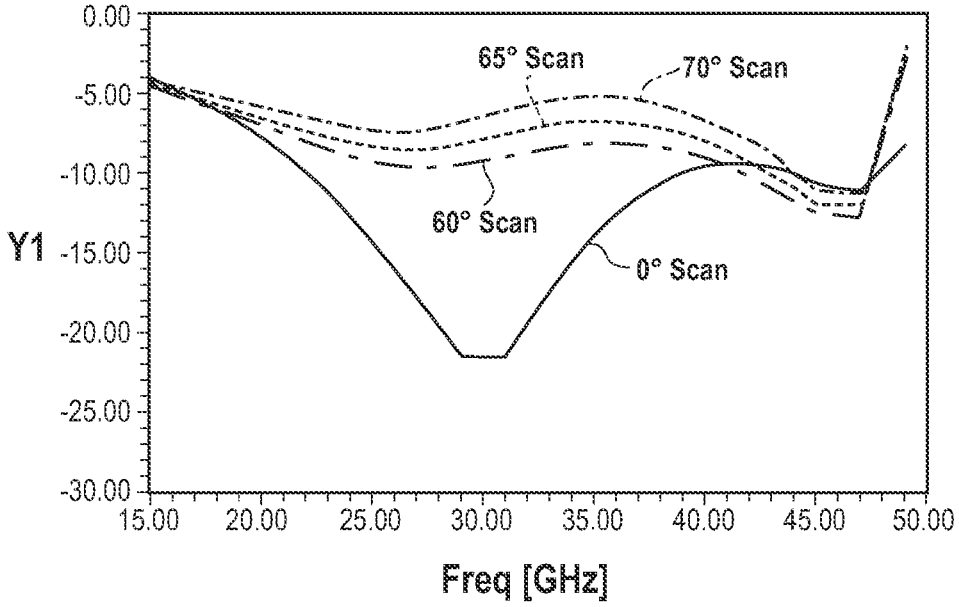
FIG. 8 is a graph representing return loss for different degrees of scan in accordance with an embodiment of the present invention.

FIG. 8 is a graph representing return loss for different degrees of scan in accordance with an embodiment of the present invention. The x-axis shows frequency in gigahertz associated with representative bandwidth for the exemplary antenna array. The y-axis shows return loss in decibels for scan angles of different degrees as indicated. Scan refers to the off-axis angle as seen by the antenna array reference to the plane perpendicular to the antenna orientation, e.g. zero degree scan refers to perpendicular direction of incident while ninety degrees scan refers to direction of incident in parallel with the antenna array plane. In this exemplary antenna array, each radiating element associated with these characteristics has dimensions of 0.106 inches as measured from the opposing vertexes, e.g. square radiating element 110 is 0.106 inches from the top vertex to its bottom vertex as seen in FIG. 1. The distance between the center of radiating element 100 and center of the radiating element 145 above element 105 is 0.15 inches. Preferably, the radiating elements are dimensioned to be ½ wavelength or slightly less at the highest frequency of operation, e.g. the length of effective antenna 125 is ½ wavelength at the highest frequency of operation. The gap dimension between adjacent vertices of bowtie elements is chosen to be 0.008 inch, such that when combining with the stripline feed layer 3, the stripline feed and slot gap provides maximum RF energy transfer from guided stripline mode to slot radiating mode.

Figure 9A:
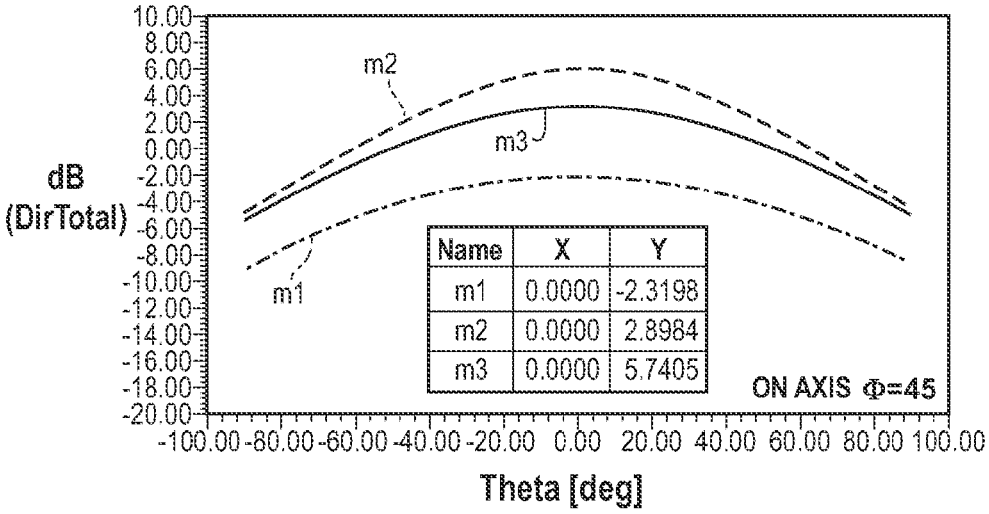
FIGS. 9*a* and 9*b* are graphs of radiation patterns representing gain at different angles relative to the plane of an embodiment of the antenna array.
Figure 9B:
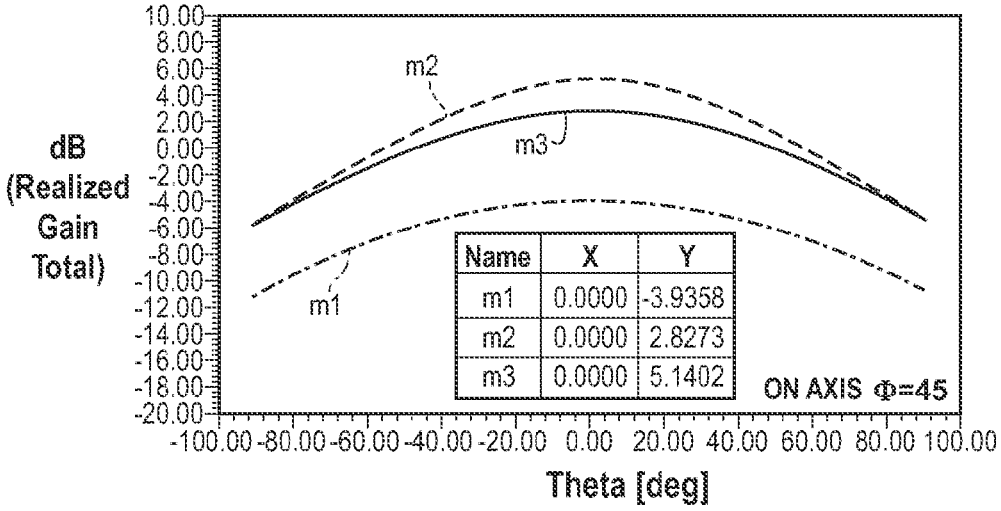

FIGS. 9*a*, and 9*b* are a set of two graphs of radiation patterns representing antenna directivity and antenna realized gain, respectively, at different frequencies, specifically m1, m2, and m3 corresponding to 17, 33 and 43 GHz.

The exemplary antenna array of bowtie radiating elements is suitable for large phased array antennas. The use of a complicated balun, normally required for feeding conventional bowtie elements, is avoided. The characteristics noted below are calculated by modeling algorithms. A wide scan ability of +/−70° relative to the normal plane to the antenna array is provided. The bandwidth capability exceeds 3:1 bandwidth ratio over full scan angles. The exemplary antenna array has a compact configuration and has low manufacturing cost due to printed circuit board type construction. The radiating elements employ stacked and end-to-end connected bowtie radiating elements sandwiched between a wide-angle impedance matching sheet and a ground plane in order to provide a beam scan over a wide coverage region. Each bowtie element is fed with a slot which is in turn excited using a stripline sandwiched between the top and bottom bowtie antennas. The stripline feed is connected to a piecewise linear coaxial feedline from the ground plane. This type of feeding arrangement avoids the complicated balun structure normally required for feeding bowtie elements and has the advantage of low insertion loss. The upper and lower stacked bowtie antennas, as opposed to a single bowtie antenna, maintains symmetry of feed point to minimize asymmetric mode generation within the cavity formed by the ground plane.

The exemplary antenna array can scan more than 70° without generating undesired lobes. The antenna array has a return loss at better than 6 decibels over the scan range and over more than an octave of bandwidth with an aperture efficiency of more than 90%.

Although exemplary implementations of the invention have been depicted and described in detail herein, it will be apparent to those skilled in the art that various modifications, additions, substitutions, and the like can be made without departing from the spirit of the invention. For example, each radiating element could have a shape other than the illustrative square shape, e.g. the radiating elements could be circular or have more than 4 sides. The number of radiating elements in each row and/or column can be increased or decreased. Dielectric materials with different properties or of different thicknesses may be utilized to achieve different impedance characteristics. As will be understood by those skilled in the art the same or similar impedance characteristics can be obtained by utilizing dielectric materials with different properties by utilizing a corresponding different thickness of the corresponding dielectric layer. Although the lower and middle sandwiches that define the feed layer structure provide a suitable way to couple signals to the upper sandwich that defines the antenna radiating structure, it will be apparent that the feed structure can be altered without adversely impacting the radiation characteristics associated with the upper sandwich The scope of the invention is defined in the following claims.

The invention claimed is:

1. An antenna array having a plurality of antenna cells where each antenna cell comprises:

first self-complementary antenna of conductive material in a first plane;

second self-complementary antenna of conductive material in a second plane parallel to the first plane, the second self-complementary antenna having substantially the same dimensions as the first self-complementary antenna;

a first dielectric layer forming a middle of a sandwich between the first and second self-complementary antennas;

a conductive strip disposed in the first dielectric layer together with the first and second self-complementary antennas forms a first stripline that carries radio frequency (RF) signals to/from the first and second self-complementary antennas;

a slot feed couples the RF signals between the first stripline and each of the first and second self-complementary antennas and provides a symmetrical coupling of the RF signals for the first and second self-complementary antennas;

a conductive layer in a third plane parallel to the first and second planes;

a second dielectric layer forming the middle of a sandwich between the conductive layer and the second plane that contains the second self-complementary antenna where the conductive layer serves as a first ground plane for signals radiated from/to the first and second self-complementary antennas.

2. The antenna array of claim 1 further comprising spaced apart rows and columns of a plurality of the antenna cells where antenna cells in the rows are oriented to produce RF polarization patterns that are orthogonal to RF polarization patterns of the antenna cells in the columns, the first and second self-complementary antenna being bowtie antennas.

3. The antenna array of claim 2 wherein one end of each of the first and second bowtie antennas of one antenna cell in a first row abuts and is conductively connected to respective ends of first and second bowtie antennas in a first antenna cell in the first row adjacent one end of the one antenna cell and the other end of each of the first and second bowtie antennas of the one antenna cell abuts and is conductively connected to respective ends of first and second bowtie antennas of a second antenna cell in the first row adjacent the other end of the one antenna cell, the first and second bowtie antennas of the one antenna cell, first antenna cell, and second antenna cell share a common radiation axis.

4. The antenna array of claim 3 wherein the antenna cells in the columns have a similar connection configuration to the antenna cells in the rows such that first and second bowtie antennas of the antenna cells in a column have respective ends that connect to the corresponding ends of first and second bowtie antennas of adjacent antenna cells in the column.

5. The antenna array of claim 4 wherein, except for antenna cells in an outer row or column, the first and second bowtie antennas are each formed of two substantially square, conductive, adjacent radiating elements each having opposing vertical and horizontal vertices; midlines are defined between the vertical and horizontal vertices, respectively; the midline between the vertical vertices define the connected ends of the first and second bowtie antennas in the rows; the midline between the horizontal vertices define the connected ends of the first and second bowtie antennas in the columns.

6. The antenna array of claim 2 wherein the first and second bowtie antennas are in alignment perpendicular to the respective planes.

7. The antenna array of claim 2 further comprising:

a second stripline disposed between the first ground plane in the third plane and a second ground plane in a fourth plane that is parallel to the third plane;

a third stripline disposed between the second ground plane in the third plane and a third ground plane in a fifth plane that is parallel to the fourth plane;

first vias connect one of the second and third striplines to the first stripline that feeds antenna cells in one of rows and columns;

second vias connect the other of the second and third striplines to the first stripline that feeds antenna cells in the other of rows and columns;

where RF signals associated with one of horizontal and vertical antenna cell polarization are carried by one of the second and third striplines and RF signals associated with the other of horizontal and vertical antenna cell polarization normal to the one polarization are carried by the other of the second and third striplines.

8. The antenna array of claim 2 further comprising a third dielectric layer disposed along the first plane opposite the second plane, the third dielectric layer coupling RF radiation to/from the first and second bowtie antennas and external atmosphere.

9. The antenna array of claim 2 wherein all conductive material and dielectric layers are formed in a stack and wherein no dielectric layers utilize a gas as the dielectric material.

10. The antenna array of claim 2 wherein the antenna cells in the rows and columns are arranged in 2×2 planar units defined by a square geometry containing 2 vertically polarized antennas in the first plane and 2 horizontally polarized elements in the first plane.

11. The antenna array of claim 1 wherein the second dielectric layer has wide angle impedance matching between the second self-complementary antenna and the first ground plane to provide antenna array radiation beam scanning over a region of about +/−70 degrees in an elevation plane and about +/−180 degrees in azimuth plane.

12. An antenna array comprising:

first self-complementary antenna cells disposed in a first plane in rows and columns;

additional self-complementary antenna cells disposed in a second plane parallel to the first plane in rows and columns where the additional self-complementary antenna cells are aligned perpendicular to and are duplicates of the first self-complementary antenna cells;

a first stripline disposed between the first and second planes carries radio frequency (RF) signals to/from the first and additional self-complementary antenna cells;

a slot feed couples the RF signals between the first stripline and each of the first and second self-complementary antenna cells and provides a symmetrical coupling of the RF signals for the first and second self-complementary antenna cells;

a conductive layer in a third plane parallel to the first and second planes serves as a first ground plane for signals radiated from/to the first and second self-complementary antenna cells.

13. The antenna array of claim 12 further comprising:

first and additional self-complementary antenna cells being first and second bowtie antennas;

a first dielectric layer forming a middle of a sandwich between the first and second bowtie antennas, the first stripline disposed in the first dielectric layer;

a second dielectric layer forming the middle of a sandwich between the conductive layer and the second plane that contains the second bowtie antenna.

14. The antenna array of claim 13 wherein the first and second bowtie antennas have a radiation axis parallel to the respective row and column in which the first and second bowtie antenna is disposed, each end of each of the first and second bowtie antennas, that is not at an end of a row or column, is conductively connected to a respective end of adjoining bowie antennas in the same respective row and column.

15. The antenna array of claim 13 wherein all dielectric layers, all bowtie antenna cells, first stripline, slot feed, and the ground plane are formed in a stack and wherein no dielectric layers utilize a gas as the dielectric material.

16. The antenna array of claim 13 wherein the second dielectric layer has wide angle impedance matching between the additional bowtie antenna cells and the first ground plane to provide antenna array radiation beam scanning over a region of about +/−70 degrees in an elevation plane and about +/−180 degrees in azimuth plane.

17. The antenna array of claim 12 wherein the bowtie antenna cells in the rows and columns are arranged in 2×2 planar units defined by a square geometry containing 2 dipole antenna cells in a row and 2 bowtie antenna cells in a column.

18. The antenna array of claim 17 wherein each bowtie antenna cell comprises a bowtie antenna, a substantially square conductive element has 4 vertices where two opposing vertices aligned in the direction of a row provide an RF feed point for two adjacent bowtie antennas in the row and the other two opposing vertices aligned in the direction of a column provide an RF feed point for two adjacent bowtie antennas in the column so that a single conductive element forms one half of four bowtie antennas.

19. An antenna array having a plurality of antenna elements where each antenna element comprises:

first self-complementary antenna of conductive material in a first plane;

second self-complementary antenna of conductive material in a second plane parallel to the first plane, the second self-complementary antenna having substantially the same dimensions as the first self-complementary antenna;

a first dielectric layer forming a middle of a sandwich between the first and second self-complementary antennas;

a conductive signal feed disposed in the first dielectric layer carries radio frequency (RF) signals to/from the first and second self-complementary antennas;

a conductive layer in a third plane parallel to the first and second planes;

a second dielectric layer forming the middle of a sandwich between the conductive layer and the second plane that contains the second self-complementary antenna where the conductive layer serves as a first ground plane for signals radiated from/to the first and second self-complementary antennas.

20. The antenna array of claim 19 wherein the RF signals are carried to/from the first and second self-complementary antennas without the use of a balun.

21. An antenna array having a plurality of antenna elements where each antenna element comprises:

first antenna of conductive material in a first plane;

second antenna of conductive material in a second plane parallel to the first plane, the second antenna having substantially the same dimensions as the first antenna;

a first dielectric layer forming a middle of a sandwich between the first and second antennas;

a signal feed structure that carries radio frequency (RF) signals to/from the first and second antennas without the use of a balun;

a conductive layer in a third plane parallel to the first and second planes;

a second dielectric layer forming the middle of a sandwich between the conductive layer and the second plane where the conductive layer serves as a first ground plane for signals radiated from/to the first and second antennas, the antenna array providing at least an octave of bandwidth relative to a center frequency.

* * * * *